US008327669B2

(12) United States Patent
Weihermueller

(10) Patent No.: US 8,327,669 B2
(45) Date of Patent: Dec. 11, 2012

(54) METHOD FOR MANUFACTURING A FLAT KNITTED FABRIC WITH A SECURED END BORDER, PARTICULARLY A BANDAGE

(75) Inventor: Stefan Weihermueller, Bayreyth (DE)

(73) Assignee: Medi GmbH & Co. KG, Bayreuth (DE)

( * ) Notice: Subject to any disclaimer, the term of this patent is extended or adjusted under 35 U.S.C. 154(b) by 25 days.

(21) Appl. No.: 12/900,769

(22) Filed: Oct. 8, 2010

(65) Prior Publication Data

US 2011/0083475 A1 Apr. 14, 2011

(30) Foreign Application Priority Data

Oct. 9, 2009 (DE) ..... 10 2009 048 720

(51) Int. Cl.
*D04B 1/18* (2006.01)

(52) U.S. Cl. ..... 66/172 E

(58) Field of Classification Search ..... 66/172 R, 66/178 R, 172 E, 171
See application file for complete search history.

(56) References Cited

U.S. PATENT DOCUMENTS

| | | | | |
|---|---|---|---|---|
| 2,703,971 | A * | 3/1955 | Bausher | 66/172 E |
| 3,255,613 | A * | 6/1966 | Burd | 66/172 R |
| 3,602,013 | A | 8/1971 | Millar | |
| 3,916,647 | A * | 11/1975 | Yabuta | 66/65 |
| 4,194,249 | A * | 3/1980 | Thorneburg | 2/239 |
| 4,750,339 | A * | 6/1988 | Simpson et al. | 66/172 R |
| 5,133,199 | A * | 7/1992 | Parikh et al. | 66/192 |
| 5,239,846 | A | 8/1993 | Kitaura et al. | |
| 6,223,565 | B1 * | 5/2001 | Cooper | 66/172 E |
| 6,588,237 | B2 * | 7/2003 | Cole et al. | 66/202 |
| 7,013,680 | B1 * | 3/2006 | Adams | 66/172 R |

FOREIGN PATENT DOCUMENTS

| | | |
|---|---|---|
| DE | 19 24 407 | 9/1965 |
| DE | 69 08 766 | 7/1969 |
| DE | 36 28 951 | 3/1988 |
| DE | 39 17 971 | 12/1990 |
| DE | 695 07 324 | 8/1999 |
| DE | 198 55 540 | 8/2000 |
| EP | 0498062 A | 8/1992 |

* cited by examiner

*Primary Examiner* — Danny Worrell
(74) *Attorney, Agent, or Firm* — Lucas & Mercanti, LLP

(57) ABSTRACT

Method for manufacturing a flat knitted fabric with a secured end border, particularly a bandage, on a flat knitting machine with front and rear needle beds, wherein initially the basic fabric is knitted on both needle beds, wherein in the border region of the fabric, at least on the inner side of the knitted fabric an elastic thread is knitted-in and that at least one of the needle beds a hot melt adhesive thread is knitted-in, and that, for forming the border, knitting is carried out only on the needle bed which knits the outer side of the fabric, so that the elastic thread located on the other needle bed is extended, whereupon the stitches are knitted off, wherein the border is pulled by the elastic threads which contract under load onto the inner side of the fabric, where it is subsequently fixed by heating of the hot melt adhesive thread.

6 Claims, 2 Drawing Sheets

METHOD FOR MANUFACTURING A FLAT KNITTED FABRIC WITH A SECURED END BORDER, PARTICULARLY A BANDAGE

This application claims the priority of DE 10 2009 048 720.4 filed Oct. 8, 2009, which is incorporated by reference herein.

BACKGROUND OF THE INVENTION

1. Field of the Invention

The invention relates to a method for manufacturing a flat knitted fabric with a secured end border, particularly a bandage, on a flat knitting machine with front and rear needle beds.

2. Related Prior Art

Flat knitted fabrics such as, for example, bandages, are usually knitted on a flat knitting machine. Such a knitted fabric has a firm initial border and a firm border at the right and left sides. However, at the end of the flat knitted fabric are unsecured stitches, i.e., open stitches, which must be secured individually and in a very time consuming process by linking at the knitting machine. Alternatively, the end of the knitted fabric can in this border region also be cleaned and secured at the border area, for example, by a protective ribbon to be sewn on; this takes place in a separate manual procedure. In other words, the measures to be taken for securing the end of the knitted fabric are complicated and time consuming, resulting in significant costs.

SUMMARY OF THE INVENTION

Accordingly, the invention is based on the problem of indicating a method which makes it possible in a simple manner to secure the stitches at the fabric end while simultaneously forming an attractive border.

For solving this problem, it is provided in a method for manufacturing a flat knitted fabric on a flat knitting machine with front and rear needle beds that initially the basic knitted fabric is knitted on one or both needle beds, wherein in the border area of the fabric at least on the needle bed forming the inner side of the fabric an elastic thread is knitted in, and wherein, for forming the border, knitting is carried out only on the needle bed which stitches the outer side so that the elastic thread located on the other needle bed is extended, and subsequently the stitches are knitted off, wherein the border is pulled onto the inner side of the fabric due to the fact that the elastic thread contracts when the load is removed therefrom, wherein it is subsequently fixed by the hot melt adhesive thread onto at least one needle bed in the basic fabric or onto the border.

The method according to the invention makes it possible, on the one hand, to securely fix the stitches by gluing by means of a hot melt adhesive thread, while, on the other hand, as a result of the quasi automatic folding over of the border by the previously extended elastic thread which contracts when the load is removed, an optically pleasing and clean border is formed which rests comfortably against the wearer. For this purpose, pursuant to the invention, initially the basic fabric is knitted on one or both needle beds. It is only necessary to form the border area. Thus, at least one elastic thread is knitted in on at least the needle bed forming the inner side of the fabric, but possibly also on both needle beds. Subsequently, for forming the border, the fabric is further knitted, however, only on the needle bed which is knitting the outer side of the fabric. Accordingly, a quasi single-layer fabric is knitted, while no further knitting is carried out on the other needle bed which previously knitted the inner side of the fabric. However, at that location, there is still on the needles the elastic thread which, after the outer side of the fabric is knitted on the other needle bed, is inevitably extended, i.e., the thread is tensioned. If a sufficient border piece has been knitted in the needle bed which knits the outer side of the fabric in order to connect the stitches of both sides, at least one machine row is knitted off, i.e., both stitches (border stitches and elastic thread stitches) are fixed to each other. When the fabric is removed, the border section which has been knitted as a single layer inevitably folds over to the inner side of the fabric after the tensioned elastic thread contracts inevitably when the load is removed and, due to the connection with the border knitted stitches takes the stitches along as a result of knitting and pulls them to the inner side of the fabric. In other words, quasi overlapping layers are now present at the inner side of the fabric. Previously, a hot melt adhesive thread has been knitted in on at least one of the needle beds, possibly also on both. Such a hot melt adhesive thread conventionally is based on a polyamide or polyester, accordingly, a thermoplastic material which melts when heated and solidifies once again during cooling. Since, after conversion in the overlapping area, also the adhesive thread is in the overlapping area, a simple heating and compressing makes possible a fixing of the folded-over border in the region of the basic fabric on the inner side of the fabric.

Due to the folding over onto the inner side of the fabric, the last row of stitches is not visible from the outer side of the fabric, so that an optically pleasing and clean fabric border area is formed. Because fixing is effected through the hot melt adhesive thread, it is additionally possible to fix the folded-over border as well as the stitches themselves, i.e., the end of the fabric is secured against dropped stitches. By knitting-in the elastic thread, the border moreover has additionally a sufficient elasticity which the flat knitted fabric also has over its entire area, for example, when manufacturing a bandage which conventionally has one or more knitted-in, encased elastomer threads so that the folded-over border also rests comfortably against the wearer.

The elastic thread may basically be knitted in any row of stitches near the border of the basic fabric. Advantageously, however, the elastic thread is knitted into the last stitch row of the basic fabric, so that it is not extended too much when the border, which must have a certain length for providing a sufficient folding-over and a sufficient overlapping, is knitted on.

The hot melt adhesive thread can also be knitted-in already into the border of the basic fabric, wherein it must be ensured that it is located in the overlapping area. However, the adhesive thread is preferably knitted into the border area and in the border area preferably in more or all border stitches. However, it can also be knitted only to the last border row of stitches. This ensures that it is always located in the overlapping area.

In accordance with a further development of the invention, the stitches can also be hung from one needle bed to the other, so that they are knitted on a common needle bed through at least one additional row of stitches. It is preferred, but not absolutely necessary, to put the border stitches on the needle bed with the stitches of the elastic thread, i.e., the stitches of the outer side of the fabric and the stitches of the expanded elastic thread are now located on the same needles. However, it is also conceivable to knit both rows of stitches already as long as they are still on the separate needle beds. If the hot melt adhesive thread is knitted as the last stitch row at the border, the connection inevitably takes place between the hot melt adhesive thread and the elastic thread.

A useful further development of the invention provides that during the knitting of the border a wave is formed on the one needle bed while the border is being knitted. In other words, the border which is knitted as a wave on the knitting bed on which the outer side of the fabric is knitted, which wave acts in a stabilizing manner and additionally has the purpose to ensure that the end of the fabric rests comfortably against the body of the wearer.

As already mentioned, the elastic thread can be knitted in on both needle beds, wherein, however, when the border is knitted only on the needle bed which knits the outer side of the fabric and, consequently, the elastic thread is extended and guided on the needles of the other non-working needle bed. Alternatively, the elastic thread can also be knitted only on the needle bed which knits the inner side of the fabric.

In addition to the method, the invention further relates to a flat knitted fabric, particularly manufactured in accordance with the above method, particularly in form of a bandage. The flat knitted fabric according to the invention is composed of a basic fabric whose border is knitted only on the outer side of the fabric and which is pulled onto the inner side of the fabric by at least one elastic thread which is guided on the inner side of the fabric while the border is knitted, which is extended and is knitted with the border, and which contracts when the load is reduced, wherein the thread is fixed by a knitted-in hot melt adhesive thread.

In the flat knitted fabric according to the invention, which has rigid borders at three edges as usual, the border of the knitted fabric is characterized in that a border is knitted only at the outer side of the fabric, while on the inner side of the fabric the elastic thread is only guided and expanded. The border stitches of the knitted outer border and the stitches of the elastic thread are knitted off together after they have been put onto common needles as necessary. Accordingly, the stitches are connected, which leads to the result that when the load is removed the contracting elastic thread pulls the border knitted on the outer side of the fabric onto the inner side of the fabric. A knitted-in hot melt adhesive thread finally serves to fix the overlapping knitted areas by melting, so that the thread is distributed in the fabric. After hardening, both threads are fixed to each other with fixed layers.

A wave is preferably knitted into the border fabric itself. The elastic thread can be knitted onto both needle beds or only on the needle bed which knits the inner side of the fabric.

BRIEF DESCRIPTION OF THE DRAWINGS

Additional advantages, features and details of the invention result from the embodiment described in the following, as well as with the aid of the drawing. In the drawing.

DETAILED DESCRIPTION OF THE INVENTION

Figure 1:
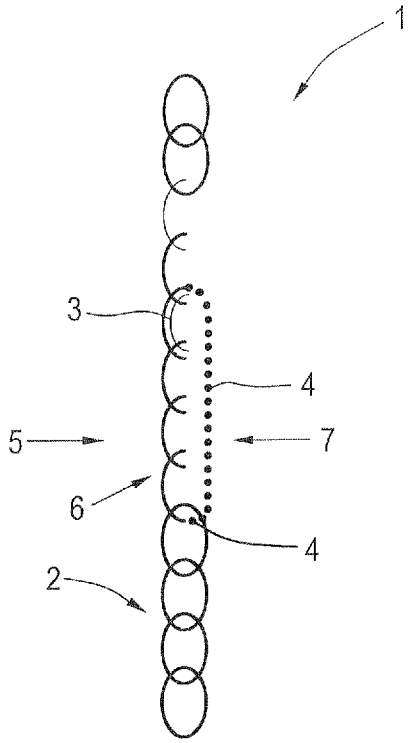
FIG. 1 is a principal illustration as a side view of the flat knitted fabric according to the invention, which is still placed on needles of the flat knitting machine.

FIG. 1 shows a flat knitted fabric according to the invention in a principal illustration from the side, at a point in time in which the fabric is not yet in the position shown in the flat bed knitting machine which is not illustrated. The flat knitted fabric 1 according to the invention is composed of a basic fabric 2 which is knitted on both needle beds. This basic fabric is illustrated by the stitches shown at the bottom of FIG. 1 and knitted to the left and right.

An elastic thread 4, usually an elastomer thread, is knitted onto the last row of stitches of the basic fabric 2, wherein the basic fabric can be knitted either on both needle beds or only on one needle bed. In the illustrated embodiment, the thread is knitted only on the rear needle bed.

Subsequently, for forming the actual border, knitting is continued only on the front needle bed which knits the outer side 5 of the fabric. In other words, only one layer is further knitted. This is illustrated in FIG. 1 by the border stitches 6 which are shown on the left. However, while the border is being knitted, the elastic thread is placed on the needles of the needle bed which is not operating when the border stitches 6 are being knitted. However, since this needle bed does not work, while knitting is carried out on the other needle bed, it may occur that the elastic thread 4 is expanded, as illustrated in FIG. 1. With increasing length of the knitted fabric knitted over the border stitches 6, the thread 4 is more and more tensioned. However, the border section does not include all too many border stitches.

In the border stitches 6, at least in a portion forming the immediate border, a hot melt adhesive thread 3 is knitted-in. It is important that the adhesive thread is present at the immediate rim of the border fabric 5 because it is assured as a result that the hot melt adhesive thread is located in the connecting area between the sides of the fabric. Also, the hot melt adhesive thread 3 can be knitted-in already earlier, for example, together with the elastic thread into the knitted fabric.

Finally, the last border stitch row or hot melt adhesive thread stitch row and the mesh rows of the elastic thread 4 are knitted off together; therefore, the rows of stitches are connected by knitting, as seen in FIG. 1 at the upper end thereof.

Figure 2:
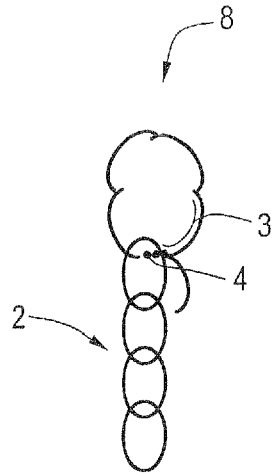
FIG. 2 shows the knitted fabric of FIG. 1 after the removal of the needles with surrounding border section.

If, as seen in FIG. 2, the knitted fabric is removed, the elastic thread 4 once again contracts. This has the result that the uppermost border stitch row 6, i.e., the hot melt adhesive thread row 3, is taken along and, as shown in FIG. 2, is pulled or folded over onto the inner side of the fabric 7. Consequently, an automatic folding over takes place, i.e., the stitch rows formed in the border 8 now overlap. By heating the hot melt adhesive thread 3, it is now possible to achieve a fixed connection in this area after the hot melt adhesive has melted in the fabric and after hardening fixedly connects the individual free stitches together.

Figure 3:
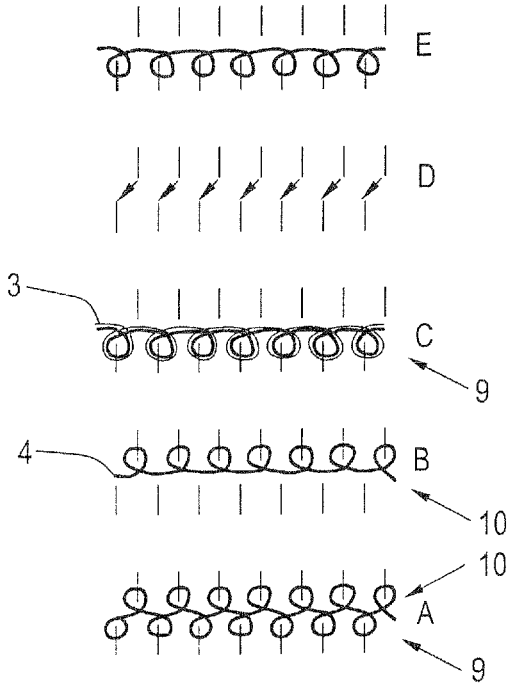
FIG. 3 are five different views of the thread pattern at different stages of the knitting process.

FIG. 3 shows the thread pattern on the two needle beds at different phases of manufacture. Illustrated in a top view is the front needle bed 9 and the rear needle bed 10 as well as the respective thread pattern. The individual method stages are indicated by letters A, B, C, D and E.

The method stage A characterizes the knitting of the basic fabric. The two needle beds 9, 10 work as indicated by areas 9 and 10.

The situation characterized by B shows knitting of the elastic thread (elastomer thread) which is knitted-in only on the rear needle bed 10 which knits the inner side of the fabric, for example, in or on the last row of stitches 10 of the basic fabric.

The situation according to C shows knitting of the actual border or the border stitches 6. In this case, only the front needle bed 9 operates for knitting with which the border stitches 6 are knitted. The other needle bed 10 does not operate. Nevertheless, the elastomer thread stitches are accumulated on the needles of the needle bed 10, which leads to tightening of the elastomer thread as the border stitches 6 are further knitted. Also shown is the hot melt adhesive thread 3 which on this needle bed is knitted in or onto the border.

In the step characterized by D, the elastomer thread stitches are hung or put on the needles which support the border stitches 6; subsequently, in the last step E, the knitting down occurs, i.e., the connection of the elastomer thread stitches and the border stitches.

Figure 4:
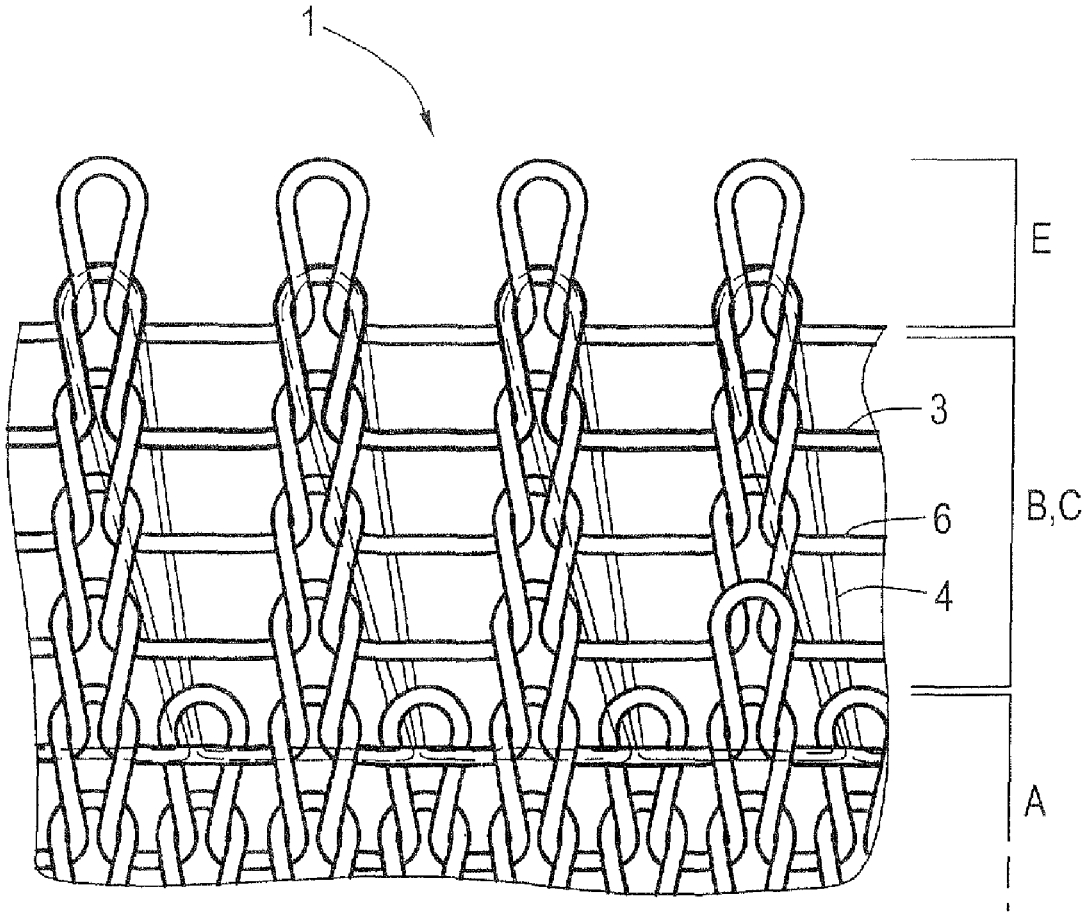
FIG. 4 is a principal illustration of the mesh formation of the knitted fabric of the invention.

In the exemplary stitch configuration illustrated in FIG. 4, as also shown in FIGS. 1 and 2, stages A through E are indicated to the extent possible, wherein the stage D, i.e., the hanging on, is not illustrated in detail, because this is not possible to illustrate. The stitch image also only shows the illustration of the fabric, while it is still in the knitting machine. Aside from the individual stitches or fabric types, it is also shown the elastic thread 4 which in this case extends tensioned over the stitches.

In conclusion, it is to be pointed out that other stitch configurations can also be produced, wherein, however, they have in common that always one tensioned elastic thread is present which effects the folding over of the border, wherein the border is always fixed by a melting adhesive thread.

The invention claimed is:

1. Method for manufacturing a flat knitted fabric with a secured end border- on a flat knitting machine with front and rear needle beds, characterized in that initially a fabric is knitted on one or both needle beds, wherein in a border region of the fabric, an elastic thread is knitted in at least on the needle bed forming an inner side of the fabric, and for forming a border knitting is carried out only on the needle bed which knits an outer side of the fabric, so that the elastic thread located on the other needle bed is extended, whereupon stitches are knitted off, wherein the border region is pulled by the elastic threads which contract under load onto the inner side of the fabric, where the thread is subsequently fixed by heating a hot melt adhesive thread knitted into the fabric or the border region on at least one needle bed.

2. Method according to claim 1, wherein the elastic thread is knitted onto the last row of stitches of the fabric.

3. Method according to claim 1, wherein the hot melt adhesive thread is knitted into one or more border stitch rows.

4. Method according to claim 1, wherein, prior to knitting, the stitches are hung from one needle bed to the other needle bed and are knitted off on a common needle bed, or that the stitches are present on both needle beds during the knitting.

5. Method according to claim 1, wherein during knitting of the border region a wave is knitted onto one of the needle beds.

6. Method according to claim 1, wherein the elastic thread is knitted-in on both needle beds or only on the needle bed which knits the inner side of the fabric.

* * * * *